US008644507B2

(12) United States Patent
Daniel et al.

(10) Patent No.: US 8,644,507 B2
(45) Date of Patent: Feb. 4, 2014

(54) GAME APPARATUS, SYSTEM AND METHOD FOR IMPROVING IN-GAME COMMUNICATIONS DURING A GAME

(76) Inventors: Isaac Sayo Daniel, Miami, FL (US); Olamide Daniel, Miami, FL (US); Michael Stibila, Lake Mary, FL (US); Claudio Schapsis, Plantation, FL (US); Eitan Schapsis, Plantation, FL (US)

( * ) Notice: Subject to any disclaimer, the term of this patent is extended or adjusted under 35 U.S.C. 154(b) by 1057 days.

(21) Appl. No.: 12/378,066

(22) Filed: Feb. 11, 2009

(65) Prior Publication Data

US 2010/0077536 A1 Apr. 1, 2010

Related U.S. Application Data

(63) Continuation-in-part of application No. 12/286,476, filed on Sep. 30, 2008, now Pat. No. 8,126,143.

(51) Int. Cl.
*H04K 1/00* (2006.01)

(52) U.S. Cl.
USPC ..... 380/251; 380/37; 380/247; 380/270; 713/155; 713/176; 713/188

(58) Field of Classification Search
USPC ..... 380/251
See application file for complete search history.

(56) References Cited

U.S. PATENT DOCUMENTS

| | | | | |
|---|---|---|---|---|
| 5,600,730 | A * | 2/1997 | Kenning et al. | 381/77 |
| 5,646,589 | A | 7/1997 | Murray et al. | |
| 6,204,813 | B1 * | 3/2001 | Wadell et al. | 342/463 |
| 6,305,221 | B1 * | 10/2001 | Hutchings | 73/488 |
| 7,171,553 | B2 | 1/2007 | Rix et al. | |
| 7,526,389 | B2 * | 4/2009 | Greenwald et al. | 702/55 |
| 7,702,101 | B2 | 4/2010 | Malcolm et al. | |
| 8,086,421 | B2 * | 12/2011 | Case et al. | 702/182 |
| 8,092,345 | B2 * | 1/2012 | Ellis et al. | 482/8 |

(Continued)

FOREIGN PATENT DOCUMENTS

| | | | |
|---|---|---|---|
| WO | WO0100281 | * | 1/2001 |
| WO | WO 0100281 A2 | * | 1/2001 |

(Continued)

*Primary Examiner* — Kambiz Zand
*Assistant Examiner* — Yonas Bayou
(74) *Attorney, Agent, or Firm* — Carol N. Green, Esq.

(57) ABSTRACT

The present invention is directed to a game apparatus, system and method for improving in-game communications, more specifically a game apparatus, system and method for allowing players to dynamically transmit and receive communications in real-time from their coaches and/or other players on or off the field concerning game play instructions to be effected on the field or court. The system and method of the invention includes a headgear being provided to at least one player, where the headgear includes a game apparatus equipped with a circuit board, electrical wiring, battery, antennae, microprocessor, communications means and displaying means all enclosed within a housing that is affixed to the headgear. The communication means receives in real-time an encrypted signal containing a game play instruction intended for execution on the field during a game. The game apparatus' microprocessor decrypts the received encrypted signal containing the game play instruction intended for execution on the field during the game, which is converted to a viewable game play instruction that is displayed via displaying means on a visor, which is in mating engagement with said headgear. The visor may be permanently affixed to the headgear or detachable and may be color treated with a tint to enhance a player's ability to view the converted viewable game play instruction displayed thereon.

27 Claims, 4 Drawing Sheets

(56) References Cited

U.S. PATENT DOCUMENTS

| | | | | |
|---|---|---|---|---|
| 2002/0132211 | A1 | 9/2002 | August | |
| 2003/0151554 | A1* | 8/2003 | McCarthy | 342/450 |
| 2004/0104845 | A1* | 6/2004 | McCarthy | 342/463 |
| 2005/0177929 | A1* | 8/2005 | Greenwald et al. | 2/425 |
| 2006/0025214 | A1 | 2/2006 | Smith | |
| 2006/0098772 | A1* | 5/2006 | Reho et al. | 377/24.2 |
| 2006/0136173 | A1* | 6/2006 | Case et al. | 702/182 |
| 2007/0143382 | A1 | 6/2007 | Luster | |
| 2007/0290801 | A1* | 12/2007 | Powell | 340/7.55 |
| 2008/0066215 | A1* | 3/2008 | Thompson | 2/175.5 |

FOREIGN PATENT DOCUMENTS

| | | | |
|---|---|---|---|
| WO | WO0110508 | * | 2/2001 |
| WO | WO 0110508 A1 | * | 2/2001 |
| WO | WO 2008/032315 A | | 3/2008 |
| WO | WO2008032315 | * | 3/2008 |
| WO | WO 2008032315 A1 | * | 3/2008 |

* cited by examiner

GAME APPARATUS, SYSTEM AND METHOD FOR IMPROVING IN-GAME COMMUNICATIONS DURING A GAME

PRIORITY CLAIM

This patent application is a continuation in part of, and claims priority to: U.S. Non-Provisional patent application Ser. No. 12/286,476 titled An Apparatus and Method for Improving In-Game Communications During a Game filed Sep. 30, 2008 now U.S. Pat. No. 8,126,143; PCT Application Serial No. PCT/US2008/013755 titled An Apparatus and Method for Improving In-Game Communications During a Game filed on 16 Dec. 2008; and United States Non-Provisional patent application Ser. No. 12/317,640 titled A System and Method for Improving Game Communications During a Game filed Dec. 23, 2008. The entire disclosures of the aforementioned patent applications are incorporated by reference as if fully stated herein.

FIELD OF THE INVENTION

The present invention is directed to a game apparatus, system and method for improving in-game communications, more specifically a game apparatus, system and method for allowing players to dynamically transmit and receive communications in real-time from their coaches and/or other players on or off the field concerning game play instructions to be effected on the field or court.

BACKGROUND OF THE INVENTION

Some sports allow coaches and/or individual players to provide game play instructions during the game, e.g. basketball, baseball, soccer, volleyball, paintball and football. A game play instruction may include but is not limited to the following: instructions, strategies, location information and or other information. In football, for example, the players are each required to learn all the "plays" in a playbook so that at game time, a coach can call selectively plays with minimal instructions to be executed on the field. However, the aforementioned games have not been able to capitalize on technological advancements in the communications field as the method of communicating the game plays still relies heavily on (a) verbal communications in a huddle; (b) running the plays over speakers; (c) hand signals; or (d) a carefully scripted written playlist on an armband, wristband, waistband or other wearable band.

The problem with the foregoing methods of communications is that they each have their limitations in providing efficient and secure transmissions. For example, a coach's instructions in a huddle risks being overheard and even broadcasted live to the public at large when a game is being televised. In football, calling the plays via speakers are generally not known for their reliability as on occasion, the transmission is garbled, interrupted, or the external noise level on the field is so high that the recipient may not be able to hear the play. As for hand signals that are transmitted either from the sidelines, on or off the field and/or court (collectively "the field"), both the hand signals and the resulting plays are heavily watched by the opposing team to anticipate and counter the play. This is especially true if a coach repeatedly uses the same hand signals to run certain plays. In that event, the opposing team may easily counter the play by calling its own plays, run interferences and/or intercept the ball.

The problem is exacerbated when a player confuses the hand signals and compromises the play by executing something other than the intended game play instruction. For example, a football coach may signal the quarterback from the sidelines to execute "WR 64" or "W Right 64," i.e. "Wide Right 64" requiring the wide receiver to run wide and pass on the right. If the quarterback forgets and or misinterprets the hand signals and instead runs narrow to the left, he may be exposed for interception, a tackle, and/or side out.

Players and coaches alike are very aware of the foregoing limitations and some players, e.g. football players, have resorted to wearing an extra wide wristband, waistband, thighband or other types of wearable bands made of stretchable material with a Velcro® strap that unfolds to reveal a panel where the game plays are committed in writing for quick review. Except, in the heat of the game, the margin for error is still high as the player must unfold this wearable band and review several plays before identifying the intended game play, all within a matter of seconds. Thus, there is a need for a system and method of transmitting and receiving secure transmissions of play instructions in real-time during the game in a format that may be readily received, easily interpreted and universally understood by the players and or coaches.

There is also need for creating a level playing field in sports, adding interest and intrigue to the games as neither team is made privy to the private communications of game play instructions between players and/or their coaches during the game.

This invention satisfies these long felt needs and solves the foregoing problems in a new and novel manner that the prior art has been unable to solve.

SUMMARY OF THE INVENTION

The present invention relates generally to a system and method for improving in-game communications which includes a headgear being provided to at least one player, where the headgear includes a game apparatus equipped with an electronic circuit, electrical wiring, battery, antennae, microprocessor, communications means and displaying means all enclosed within a housing that may be permanently or temporarily affixed to the headgear. In one embodiment of the invention, the headgear secures the game apparatus, which is formed from a semi-rigid material, preventing breakage, while preventing damage and injury to the player. The game apparatus is capable of absorbing shock associated with any one or more of the following: football tackle, kick, sliding into base, hit by a pitch, a bat, a batted ball, a clubbed ball and/or heavy body contact. The headgear may include but is not limited to: a helmet, goggles, hat, mask, cap, hood, headband or any other headgear that is well known and used in the art suitable for practicing the invention.

The electronic circuit comprises of a circuit board having the microprocessor positioned thereon and electrically connected by electrical wiring to the communication means. The game apparatus' communication means receives in real-time an encrypted signal containing a game play instruction intended for execution on the field during a game or sporting event (collectively "the game"). A game play instruction may include but is not limited to the following: instructions, strategies, location information and or other information. The game apparatus' microprocessor decrypts the received encrypted signal containing the game play instruction intended for execution on the field during a game, where the decrypted signal may be converted to a viewable game play instruction that is displayed via displaying means, e.g. a miniature projector, on a visor that is in mating engagement with the headgear. The visor may be any one of the following:

permanently affixed to the headgear or detachable, and may be color treated with a full or a graduated tint to enhance a player's ability to view the converted viewable game play instruction displayed thereon during variable lighting conditions.

The game apparatus' displaying means displays the converted viewable game play instruction in any one or more of the following formats: text, sketch and/or visual. The displaying means includes but is not limited to PicoP's ultra miniature projector, liquid crystal display, transparent light crystal display, or other well known miniature projectors that are well known and used in the art, as well as any future display technologies. The display of the converted viewable game play instruction may be displayed for predetermined period of time, e.g. 10-20 seconds, before ending the display, thus providing the player with ample time for viewing the game play instruction. In alternate embodiments of the invention, the converted viewable game play instruction may be displayed continuously until the game is over or a player selectively terminates the display by pressing a button pre-programmed to end the display. The game apparatus may include programmable buttons, which may be programmed to do any one or more but not limited to the following functions: replay the converted viewable game play instruction, end the display, reject and/or accept the converted viewable game play instruction or any other programmable functions that may be desired. In one embodiment of the invention, the game apparatus includes a GPS location determining device activated by a programmable button, where an exemplary button may be programmed and customized to transmit the players' current location to other players within the same group when pressed. This embodiment may be useful in paintball as a player may transmit his/her current location information to others within the group, provide directions for attack or other strategies using the programmable buttons.

The game apparatus, system and method of improving in-game communications during a game may be used for any one or more of the following games, which includes but is not limited to: football, baseball, volleyball, soccer, paintball and basketball as well as any other games where a coach and/or players are allowed to communicate game play instructions to players on or off the field during the game to be executed on the field. In certain games, game play instructions are called by either the coach, or a designated player (or players), e.g. a captain or quarterback. The present invention allows all teammates wearing the invention, e.g. offensive and defensive linemen in football, to simultaneously receive in real-time the converted viewable game play instruction called by the coach and/or another player for a coordinated team execution on the field. Thus, a coach calling a game play instruction during the heat of the game can easily transmit in real-time the intended game play instruction to the players on or off the field. In this manner, the players on the field wearing the headgear with the game apparatus can implement the game play instruction immediately, while the players who are off the field can implement the game play instruction when those players enter the game.

The game apparatus' circuit comprises of a circuit board having a microprocessor positioned thereon and electrically connected to the communication means which receives the encrypted signal containing the game play instruction from a portable remote terminal ("PRT"). The PRT may comprise of a cell phone, computer, laptop, PDA and/or other WLAN communication devices that are known and readily used in the art to transmit and/or receive wireless communications. In other embodiments of the invention, the headgear may function as a PRT transmitting and receiving wireless communications to other players and or coaches on or off the field. The game apparatus communicates with the PRT via the game apparatus' communication means, which employ short range wireless protocol. Said communication means may comprise of a transceiver, e.g. a Zigbee transceiver with integrated radio and shared antennae, or direct conversion receivers; digital radio receivers; super heterodyne receivers; or any other receivers or transceivers that are well known and used in the art. Preferably, the communication means include Blue Tooth, Zigbee, 802.11 series, or any other short range wireless protocol that is well known and used in the art and other future short range wireless protocol suitable for transmitting and receiving data over a short distance.

While the invention has been described in conjunction with football, it is understood that the game apparatus, system and method of improving in-game communications during a game may be used for several other games or sporting events.

An object of the present invention is to provide a game apparatus for providing speedy, secure real-time in-game communications between players and/or coaches during a game that overcomes the limitations of the prior art.

Another object of the present invention is to provide a game apparatus which includes a circuit board, battery, displaying means, microprocessor and electrical circuit.

Another object of the present invention is to provide a game apparatus where the circuit board, electrical circuit, battery and microprocessor are enclosed within a housing that is affixed to headgear.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Further objectives and advantages of the present invention may be derived by referring to the detailed description and claims when considered in connection with the Figures, where like reference numbers refer to similar items throughout the Figures.

DETAILED DESCRIPTION OF THE PREFERRED EMBODIMENT

Figure 1:
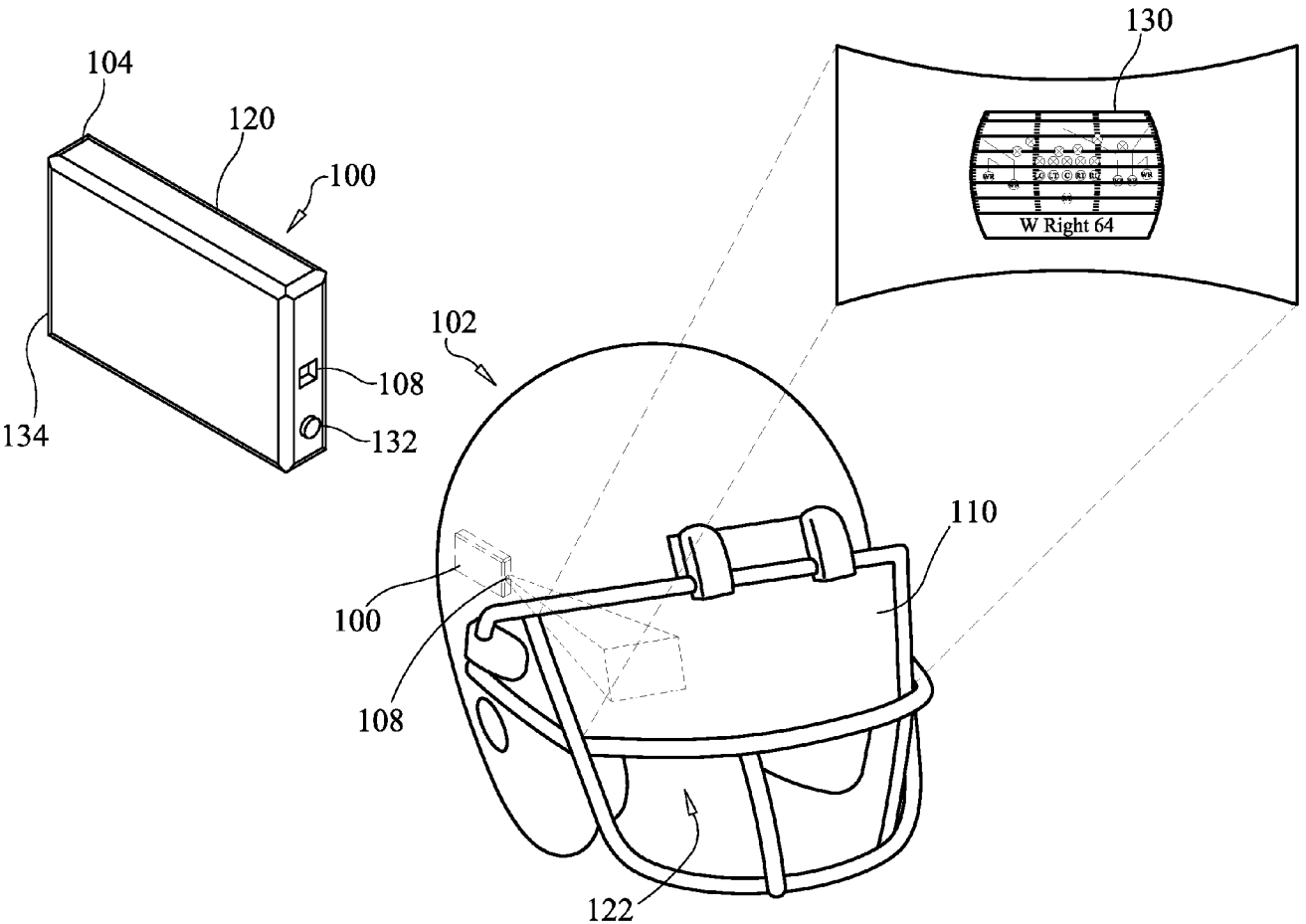
FIG. 1 is an illustrative view of the game apparatus attached to the headgear according to an embodiment of the present invention.

The following discussion describes in detail an embodiment of the game apparatus, system and method of improving in-game communications during a game. This discussion should not be construed as limiting the invention to these particular embodiments as practitioners skilled in the art will recognize numerous other embodiments as well.

For definition of the complete scope of the invention, the reader is directed to appended claims. Turning now descriptively to the drawings, in which similar reference characters denote similar elements throughout the several views.

FIG. 1 is an illustrative view of the game apparatus 100 affixed to the headgear 102 according to an embodiment of the present invention. As seen in FIG. 1, the headgear 102 illustratively is a helmet. However, it is understood that the headgear 102 may include but is not limited to: a helmet, goggles, hat, mask, cap, hood, headband or any other headgear 102 that is well known and used in the art suitable for practicing the invention. Here, the headgear 102 includes a game apparatus 100 equipped with communications means 104 (not shown), a microprocessor 106, displaying means 108, circuit board 112, electrical wiring 114, battery 116, and antennae 118 all enclosed within a housing 120 that is affixed to the headgear 102. The game apparatus 100 may be permanently or temporarily affixed to the headgear 102. In FIG. 1, illustratively the game apparatus 100 is affixed to the headgear's interior 122. In alternate embodiments of the invention, the game apparatus 100 may be affixed anywhere on the headgear 102 in any manner capable of producing the projection.

The game apparatus 100 may be formed from a semi-rigid material preventing breakage, while preventing damage and injury to the game apparatus 100 and player. The game apparatus 100 is capable of absorbing shock associated with any one or more but not limited to the following: football tackle, kick, sliding into base, hit by a pitch, a bat, a batted ball, a clubbed ball and/or heavy body contact. The game apparatus' communication means 104 (not shown) receives in real-time wireless communications of an encrypted signal 124 containing a game play instruction 126 (not shown) through a wireless communications network 128 (not shown). A game play instruction 126 (not shown) may include but is not limited to the following: instructions, strategies, location information and or other game information. The communication means 104 (not shown) may include but is not limited to Blue Tooth, ZigBee, 802.11 series, or any other short range wireless protocol that is well known and used in the art and other future short range wireless protocol suitable for transmitting and receiving data over a short distance. Upon receipt of an encrypted signal 124 containing the game play instruction 126 (not shown) intended for execution on the field during the game, the game apparatus' microprocessor 106 decrypts the received encrypted signal 124 converting it to a viewable game play instruction 130. The converted viewable game play instruction 130 is then relayed to the game apparatus' displaying means 108 for display on a visor 110.

The game apparatus' displaying means 108 displays the converted viewable game play instruction 130 on a visor 110 that is in mating engagement with the headgear 102. The displaying means 108 may include but is not limited to PicoP's ultra miniature projector, liquid crystal display or transparent light crystal display, any other well known miniature projectors that are well known and used in the art, as well as any future display technologies. In one embodiment, the displaying means 108 employ an ultra miniature projector, which displays the converted viewable game play instruction 130 for a predetermined period of time, e.g. 10-20 seconds, before ending the display, giving the player ample opportunity to view and memorize the converted viewable game play instruction 130. The converted viewable game play instruction 130 may be displayed in any one or more of the following formats: text, sketch and visual. In alternate embodiments of the invention, the converted viewable game play instruction 130 may be displayed continuously until the game is over or a player selectively terminates the display by pressing a button 132 (not shown) programmed to stop the display.

The visor 110 may be made from hard plastic capable of surviving forceful impact during light to heavy contact sports and/or games. The visor 110 may be permanently affixed to the headgear 102 or it may be detachable. In either event, the visor 110 acts as a display screen for the converted viewable game play instruction 130. In certain embodiments of the invention, the visor 110 may be color treated with a full or a graduated tint to enhance a player's ability to view the converted viewable game play instruction 130 displayed thereon during daylight, twilight, evening or nighttime. In FIG. 1, illustratively the game apparatus 100 is located on the left side of the headgear's interior 122. However, it is understood that the game apparatus 100 could easily have been on the right side or any other location on the headgear 102 and or visor 110 that would provide an unobstructed view of the converted viewable game play instruction 130.

All players on the same team on or off the field may wear the headgear 102 equipped with a game apparatus 100. In this manner, all players wearing the invention may simultaneously receive in real-time an encrypted signal 124 containing the game play instruction 126 (not shown) via the game apparatus' communication means 104 (not shown) as transmitted by the coach and/or another player for a coordinated team execution on the field, regardless of whether the player is on or off the field. Preferably the communication means 104 (not shown) include a combined wireless transceiver, e.g. a Zigbee transceiver with integrated radio and shared antennae. However, other wireless transceivers that are well known and used in the art may be used to practice the invention.

Figure 2:
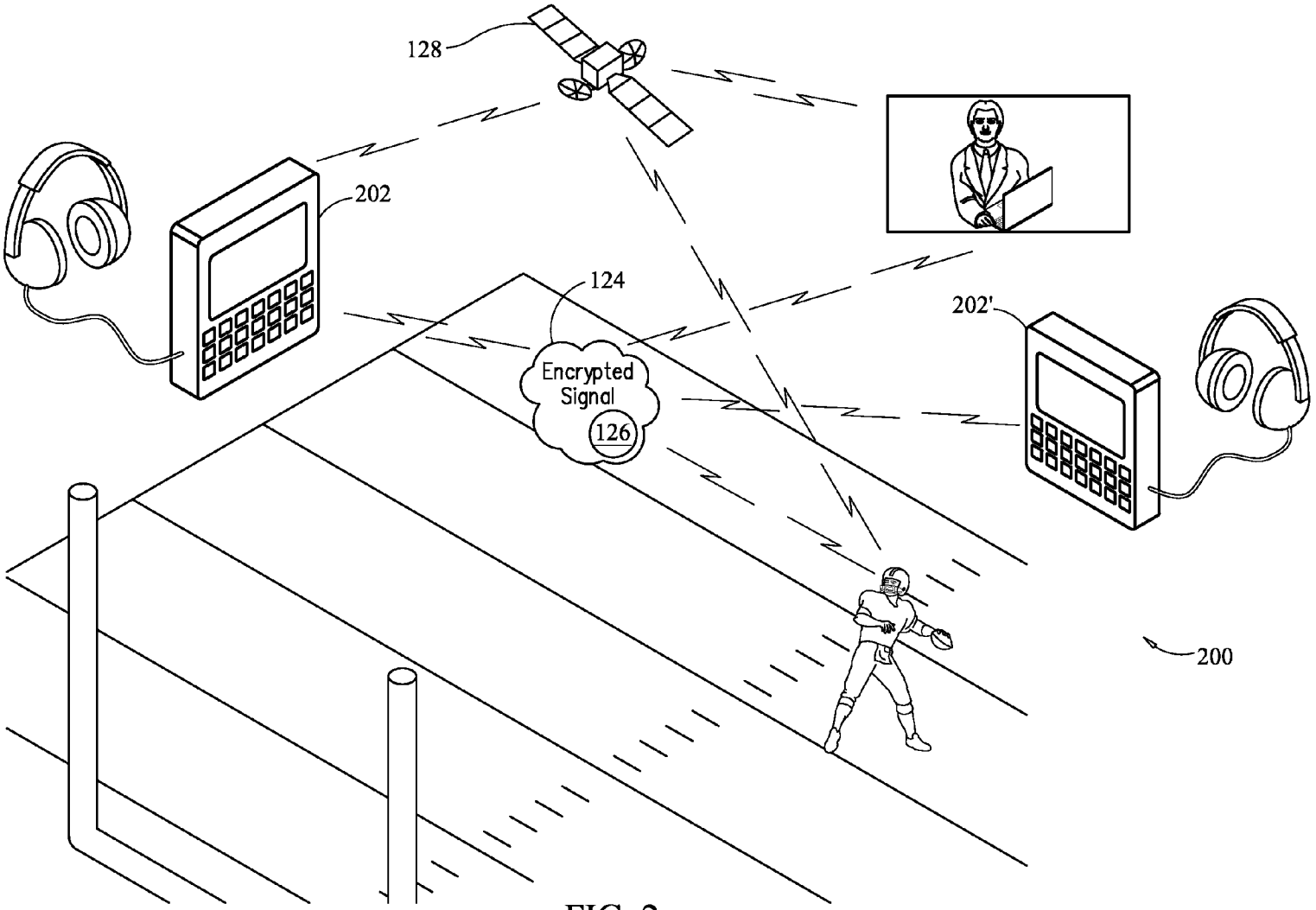
FIG. 2 is an illustrative view of a system of the invention according to an embodiment of the invention.
Figure 3:
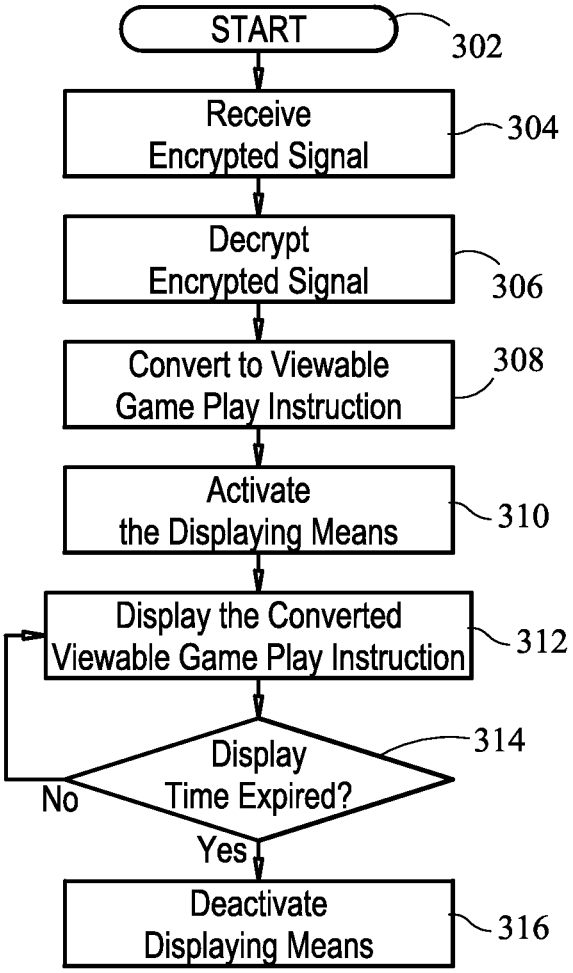
FIG. 3 is an illustrative view of a communication process according to an embodiment of the invention.

FIGS. 2 & 3 respectively show an illustrative view of a system 200 according to an embodiment of the present invention and a communication process 300 according to an embodiment of the present invention. Illustratively, as a football game progresses a coach on the field, in the viewing box or anywhere else on or off the field or in the nearby vicinity may require for example, the quarterback to execute a particular intended game play instruction. As such, a coach may select an intended game play instruction from a PRT 202 that is provided with software to include a playlist of game play instructions stored thereon in text, codes and/or visual format. Alternatively, the coach may provide an audio game play instruction or input a text message or sketch of the intended game play instruction to the PRT 202 to be transmitted to the game apparatus 100.

Once the intended game play instruction has been selected, texted, sketched or provided verbally to the PRT 202, the PRT 202 transmits in real-time an encrypted signal 124 containing the game play instruction 126 (not shown) intended to be executed on the field during the game, to the game apparatus' communication means 104 (not shown) using for example WiHLoN™, ZigBee, Blue Tooth, 802.11 series, or any other short range wireless protocol that is well known and used in the art. As mentioned supra, the communication means 104 (not shown) may comprise of a transceiver, e.g. a ZigBee transceiver with integrated radio and shared antennae; direct conversion receivers; digital radio receivers; super heterodyne receivers; or any other receivers or transceivers that are well known and used in the art. In other embodiments of the invention, the headgear 102 may function as a PRT 202, transmitting and receiving wireless communications to other players and or coaches on or off the field.

Upon receipt of the encrypted signal 124 (in step 304) containing the game play instruction 126 (not shown) intended to be executed on the field during the game, the game apparatus' microprocessor 106 decrypts the encrypted signal 124 (step 306) containing the game play instruction 126 (not shown) converting it into a viewable game play instruction 130 (step 308). The microprocessor is programmed to activate the displaying means 108 (step 310) to display the converted viewable game play instruction 130 (step 312) for display on the visor 110, all executed in real-time within a matter of seconds.

In one embodiment, the displaying means 108 may be programmed to display the converted viewable game play instruction 130 for a predetermined period, e.g. 10-20 seconds and will continue to verify if the display time has expired as in step 314. If the display time has not expired, the displaying means 108 will continue to display the converted viewable game play instruction 130 until it does by returning to steps 312-314. Once the display time has expired, the microprocessor 106 will deactivate the displaying means 108 as in step 316 and cease the display. In this manner, the coach's instructions and the players' communications of intended game play instructions to be implemented on the field are transmitted in real-time in a secure environment that will not be intercepted, overheard, and/or anticipated by the opposing team or side.

Figure 4:
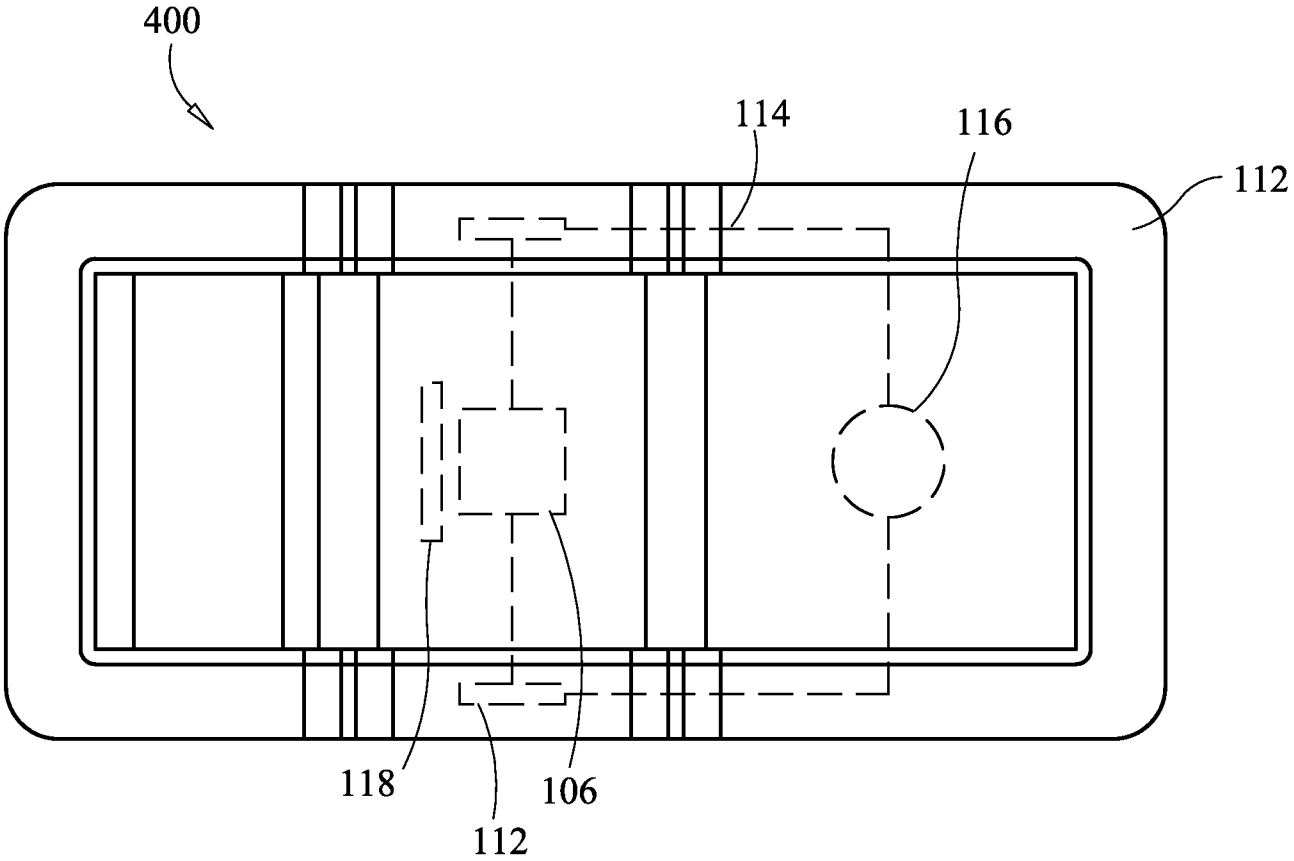
FIG. 4 is an illustrative view of the circuit assembly of the game apparatus according to an embodiment of the present invention.

FIG. 4 is an illustrative view of the circuit assembly 400 of the game apparatus 100 according to an embodiment of the present invention. The circuit assembly 400 comprises of a circuit board 112, having a battery 116, i.e. which serves as a power source, and microprocessor 106 positioned thereon. Electrical wiring 114 connects the circuit board 112 with the displaying means 108. Preferably, the circuit board 112 is formed from a polyimide film which is flexible yet can remain stable in a wide range of extreme temperatures, e.g. Kapton®. However, the circuit board 112 may be formed from silicon, fiberglass, Mylar, or other suitable materials that are well known and used in the art. An antenna 118 is electrically connected via conventional electrical wiring 114 to the microprocessor 106 on the circuit board 112 or alternatively imbedded within the microprocessor 106.

The game apparatus 100 includes communication means 104 (not shown) for the receipt of wireless communications through a wireless communications network 128 (not shown). Said communication means 104 (not shown) may include but is not limited to Blue Tooth, Zigbee, 802.11 series, or any other short range wireless protocol that is well known and used in the art and other future short range wireless protocol suitable for transmitting and receiving data over a short distance. Upon receipt of an encrypted signal 124 containing the game play instruction 126 (not shown) for execution on the field during the game, the game apparatus' microprocessor 106 decrypts the encrypted signal 124 containing the game play instruction 126 (not shown) converting it to a viewable game play instruction 130. The microprocessor 106 activates the displaying means 108 which displays the converted viewable game play instruction 130 on a visor 110 that is in mating engagement with the headgear 102. The converted viewable game play instruction 130 may be displayed either in text, sketch and/or a visual display for a predetermined period of time, e.g. 10-20 seconds.

In one embodiment of the invention, the game apparatus' communication means 104 (not shown) also includes programmable buttons 132, 132", 132''' (not shown), which may be programmed to do any one or more but not limited to the following functions: replay the converted viewable game play instruction 130, end the display by deactivating the displaying means 108, or to provide feedback to the sender of the game play instruction as to either the player's rejection or acceptance of the converted viewable game play instruction 130 or any other programmable functions that may be desired. In yet another embodiment of the invention, the game apparatus 100 includes a GPS location determining device 134 (not shown) activated by a programmable button 132 (not shown), which may be programmed to transmit the players' current location information to other players within the same group. This embodiment may be useful in paintball as a player may transmit his/her current location information to others within the group, provide directions for attack or other strategies using the programmable buttons 132, 132", 132''' (not shown).

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A system of providing feedback comprising:

(a) a non-performance monitoring game apparatus affixed to a headgear, wherein the game apparatus includes an accelerometer, wherein said accelerometer provides feedback as game apparatus is equipped with an electronic circuit, electrical wiring, battery, antennae, microprocessor, communications means and displaying means all enclosed within a housing, wherein said communication means receives in real-time an encrypted signal containing a game play instruction that includes instructions and strategies intended for execution on the field during a game, wherein said microprocessor decrypts said received encrypted signal containing said game play instruction intended for execution on the field during said game, wherein said decrypted signal is converted to a viewable game play instruction that is displayed via said displaying means on a visor, which is in mating engagement with said headgear and wherein the game apparatus includes programmable buttons positioned on the game apparatus that are configured for controlling the display of the received game play instruction, providing feedback to the sender of the game play instruction or activating a location determining device configured for transmitting the player's current geographical location information to other players within the group.

2. The system of claim 1, wherein said game play instruction includes but is not limited to the following: instructions, strategies and location information.

3. The system of claim 1, wherein said displaying means includes but is not limited to PicoP ultra miniature projector, liquid crystal display or transparent light crystal display.

4. The system of claim 1, wherein said visor may be any one of the following: permanently affixed to the headgear or detachable.

5. The system of claim 1, wherein said visor may be color treated with a tint in any one of the following manner: full or graduated.

6. The system of claim 1, wherein said converted viewable game play instruction may be displayed in any one of the following formats: text, sketch and visual.

7. The system of claim 1, wherein said apparatus may be used for any one or more of the following games, which includes but is not limited to: football, baseball, volleyball, soccer, paintball and basketball.

8. The system of claim 1, wherein said headgear may include but is not limited to any one or more of the following: a helmet, goggles, hat, mask, cap, hood and headband.

9. The system of claim 1, wherein the programmable buttons may be programmed to do any one or more of the following functions: replay the converted viewable game play instruction, end the display, reject the converted viewable game play instruction, or accept the converted viewable game play instruction.

10. A method for improving in-game communications comprising:

(a) receiving in real-time an encrypted signal containing a game play instruction intended for execution on the field during a game, wherein said encrypted signal containing said game play instruction is received on a non-performance monitoring game apparatus affixed to a headgear as worn by a player; and (b) decrypting said received encrypted signal containing said game play instruction that includes instructions and strategies intended for execution on the field during said game;

(c) converting the decrypted signal to a viewable game play instruction;

(d) displaying said viewable game play instruction via displaying means unto a visor, which is in mating engagement with a headgear; and (e) providing programmable buttons positioned on the game apparatus that are configured for controlling the display of the received game play instruction, providing feedback to the sender of the game play instruction or activating a location determining device configured for transmitting the player's current geographical location information to other players within the group.

11. The method of claim 10, wherein said game play instruction includes but is not limited to the following: instructions, strategies and location information.

12. The method of claim 10, wherein said displaying means includes but is not limited to PicoP ultra miniature projector, liquid crystal display or transparent light crystal display.

13. The method of claim 10, wherein said visor may be any one of the following: permanently affixed to the headgear or detachable.

14. The method of claim 10, wherein said visor may be tinted in any one of the following manner: full or graduated.

15. The method of claim 10, wherein said converted viewable game play instruction may be displayed in any one of the following formats: text, sketch and visual.

16. The method of claim 10, wherein said apparatus may be used for any one or more of the following games, which includes but is not limited to: football, baseball, volleyball, soccer, paintball and basketball.

17. The method of claim 10, wherein said headgear may include but is not limited to: a helmet, goggles, hat, mask, cap, hood, or headband.

18. The method of claim 10, wherein the programmable buttons may be programmed to do any one or more of the following functions: replay the converted viewable game play instruction, end the display, reject the converted viewable game play instruction, or accept the converted viewable game play instruction.

19. An apparatus for improving communications during a sporting event comprising of:

(a) a non-performance monitoring game apparatus affixed to a headgear, wherein the game apparatus is equipped with an electronic circuit, electrical wiring, battery, antennae, microprocessor, communications means and displaying means all enclosed within a housing, wherein said electronic circuit comprises of a circuit board having a microprocessor positioned thereon and electrically connected by electrical wiring to said communication means;

(b) communication means to receive in real-time an encrypted signal containing a game play instruction that includes instructions and strategies intended for execution on the field during a game;

(c) microprocessor to decrypt said received encrypted signal containing said game play instruction intended for execution on the field during said game, and for converting said decrypted signal to a viewable game play instruction;

(d) displaying means for displaying said converted viewable game play instruction on a visor, which is in mating engagement with a headgear;

(e) battery for powering said game apparatus; and (f) programmable buttons positioned on the game apparatus that are configured for controlling the display of the received game play instruction, providing feedback to the sender of the game play instruction or activating a location determining device configured for transmitting the player's current geographical location information to other players within the group.

20. The apparatus of claim 19, wherein said game play instruction includes but is not limited to the following: instructions, strategies and location information.

21. The apparatus of claim 19, wherein said displaying means includes but is not limited to: PicoP ultra miniature projector, liquid crystal display or transparent light crystal display.

22. The apparatus of claim 19, wherein said converted viewable game play instruction may be displayed in any one of the following formats: text, sketch and visual.

23. The apparatus of claim 19, wherein said game apparatus may be used for any one or more of the following games, which includes but is not limited to: football, baseball, volleyball, soccer, paintball and basketball.

24. The apparatus of claim 19, wherein said headgear includes but is not limited to: a helmet, goggles, hat, mask, cap, hood, or headband.

25. The apparatus of claim 19, wherein game apparatus is formed from a semi-rigid material for preventing breakage, damage and injury to the wearer.

26. The apparatus of claim 19, wherein said game apparatus is capable of absorbing shock associated with any one or more of the following: football tackle, kick, sliding into base, hit by a pitch, a bat, a batted ball, a clubbed ball and/or heavy body contact.

27. The apparatus of claim 19, wherein said programmable buttons may be programmed to do any one or more of the following functions: replay the converted viewable game play instruction, end the display, reject the converted viewable game play instruction, or accept the converted viewable game play instruction.

* * * * *